United States Patent [19]

Bloom

[11] Patent Number: 4,557,063

[45] Date of Patent: Dec. 10, 1985

[54] PRESSED NUMBER POCKET

[76] Inventor: Daniel H. Bloom, 24601 Priscilla Dr., Dana Point, Calif. 92629

[21] Appl. No.: 603,073

[22] Filed: Apr. 23, 1984

[51] Int. Cl.[4] ..... G09F 3/20

[52] U.S. Cl. ..... 40/5; 40/10 R; 40/16; 40/152.1; 40/122

[58] Field of Search ..... 40/5, 10 R, 16 R, 152.1, 40/122, 16, 10

[56] References Cited

U.S. PATENT DOCUMENTS

| | | | |
|---|---|---|---|
| 100,338 | 3/1870 | Tannatt | 40/122 |
| 1,356,892 | 10/1920 | Stevens | 40/159 |
| 1,515,338 | 11/1924 | Carter | 40/154 |
| 1,581,822 | 4/1926 | Warden . | |
| 1,840,193 | 1/1932 | Feldman et al. . | |
| 2,156,833 | 5/1939 | Bangs . | |
| 2,262,501 | 11/1941 | Johnson . | |
| 2,784,511 | 3/1957 | Price | 40/152.1 |
| 2,787,853 | 4/1957 | Nichols | 40/152.1 |
| 3,538,630 | 11/1970 | De Korte et al. . | |

*Primary Examiner*—Gene Mancene
*Assistant Examiner*—Wenceslao J. Contrera
*Attorney, Agent, or Firm*—Christie, Parker & Hale

[57] ABSTRACT

A sign holder for a packet of planar members bearing characters for display. Deformable material having a sheet portion has a pocket for receipt of the packet. The pocket has a front retaining wall formed from the sheet portion to prevent the packet from moving out of the pocket in a front direction. The pocket also has, pressed from the sheet portion in a direction away from the front direction, the following: First and second opposed and spaced apart side walls, and a third side wall located in the pocket intermediate the first and second side walls. The first, second and third side walls retain the packet in directions transverse to the front direction. First, second and third backing walls are connected, respectively, to the first, second and third side walls. The first, second and third backing walls inhibit movement of the packet in a direction opposite to the front direction. At least one gap substantially separates the first, second and third backing walls from each other. At least one bridge in the at least one gap extends between and provides rigidity to the first and second backing walls.

14 Claims, 9 Drawing Figures

10

34
36
28
35
16
30
14
22
24
14
18
32
26
20
12
A
B

PRESSED NUMBER POCKET

BACKGROUND OF THE INVENTION

This invention relates to signs and sign holders, and more specifically to sign holders having sign pockets.

DESCRIPTION OF PRIOR ART

Sign holders are known which provide for interchangeability of one sign character or a group of characters, such as numerals or letters, with another but require multiple pieces to hold the characters in place. Examples are Warden, U.S. Pat. No. 1,581,822, and Bangs, U.S. Pat. No. 2,156,833.

Feldman et al., U.S. Pat. No. 1,840,193, provides a price card with flexible characters and display card inserted and held in place by tangs or clips. De Korte et al., U.S. Pat. No. 3,538,630, shows a display holder for holding cards having numerals inserted flat against the holder and between a pair of L-shaped flanges.

Such devices are often unwieldy and unstable in outdoor environments. It is desirable in devices used outdoors to have relatively rigid character retention characteristics so that the characters do not become deformed or fall out of the holder in adverse environment.

Other sign holders are more permanent in nature, such as the device of Johnson, U.S. Pat. No. 2,262,501.

FIGS. 8 and 9 show a prior art device for holding a sign and includes a sign panel 110 for holding a number pack 112. The number pack includes a plurality of sheets or cards having sides each displaying a number, of which only one is shown. Individual cards are held together by number pack clips 114. The sign panel includes a backstop 116 forming part of a pocket 118 having pocket sides 120. Pocket 118 is attached to sign panel 110 by a plurality of pocket rivets 122. The backstop 116 has clip apertures 124 cut therein and also a finger aperture 126. Backstop 116 is so cut or pressed as to form a bottom pocket edge 128 along the lower portion of pocket 118 and also a pack slot 130 between backstop 116 and the back side of sign panel 110 (FIG. 9). The prior art device is more costly and time-consuming to produce due to the two-piece construction and requirement for fastening the backstop 116 to the sign panel 110.

Another prior art sign holder is known having a pocket for containing and supporting a number packet. This sign holder and pocket are formed from a planar metal panel which is stamped or cut to leave, extending into a generally rectangular-shaped opening, three extensions. Each extension is connected to and extends from a different one of three sides of the opening. The extensions are then pressed rearwardly from the plane of the planar panel to form, from each extension, a rear wall for the pocket and between the rear wall and the planar panel a connecting wall. The connecting walls form the bottom and side walls of the pocket. Two of the rear walls extend in opposite directions toward each other along the rear of the pocket but are not interconnected. As a result, as the rear walls extend further toward each other, the gauge of material must be increased to provide the desired rigidity to the structure. In this sign holder, the rear walls are relatively short and, as a result, there is a large void between the two rear walls which extend in opposite directions. The void allows a number packet to pass through the void and therefore become misaligned or even fall through the rear of the pocket during insertion.

BRIEF SUMMARY OF THE INVENTION

The present apparatus and method overcomes deficiencies in the prior art. One embodiment of the invention is a sign holder for a packet of planar members bearing characters for display. Deformable material having a sheet portion has a pocket for receipt of the packet. The pocket has a front retaining wall formed from the sheet portion to prevent the packet from moving out of the pocket in a front direction. The pocket also has, pressed from the sheet portion in a direction away from the front direction, the following: First and second opposed and spaced apart side walls, and a third side wall located in the pocket intermediate the first and second side walls. The first, second and third side walls retain the packet in directions transverse to the front direction. First, second and third backing walls are connected, respectively, to the first, second and third side walls. The first, second and third backing walls inhibit movement of the packet in a direction opposite to the front direction. At least one gap substantially separates the first, second and third backing walls from each other. At least one bridge in the at least one gap extends between and provides rigidity to the first and second backing walls.

An embodiment of the invention is also a process for making a sign holder pocket, from a planar sheet portion of material, for a packet of character-bearing members and includes the following steps. Form in the planar sheet portion at least a first gap, a second gap spaced from the first gap, and a third gap extending substantially from the first gap to the second gap so that the gaps leave first and second backing walls located in the sheet portion on opposite sides of the third gap and located between the first and second gaps. The step of forming comprises the steps of leaving a bridge in the sheet portion, within at least one of the gaps, connected between the first and second backing walls, forming a weakened portion in the bridge between the first and second backing walls and leaving in the sheet portion a front wall and a third backing wall extending into at least one of the gaps and located on the opposite side of the first and second backing walls from the first gap, forcing the first, second and third backing walls out of the plane of the sheet portion to form such pocket. The step of forcing includes the steps of forming, from the sheet portion, a first side wall for the pocket located intermediate the first backing wall and the plane of the sheet portion, a second side wall for the pocket located intermediate the second backing wall and the plane of the sheet portion and a third side wall located intermediate the third backing wall and the plane of the sheet portion. The step of forcing also separates further the first and second backing walls while deforming the bridge at the weakened portion.

Thus, the device and process according to the present invention provide a sturdy support for a packet of character-bearing members capable of withstanding influences from the outdoor elements and provide a unitary sign holder which is easily and inexpensively constructed. The device also provides for ease of insertion and removal of the packet of character-bearing members.

DETAILED DESCRIPTION OF THE PREFERRED EMBODIMENT

Figure 1:
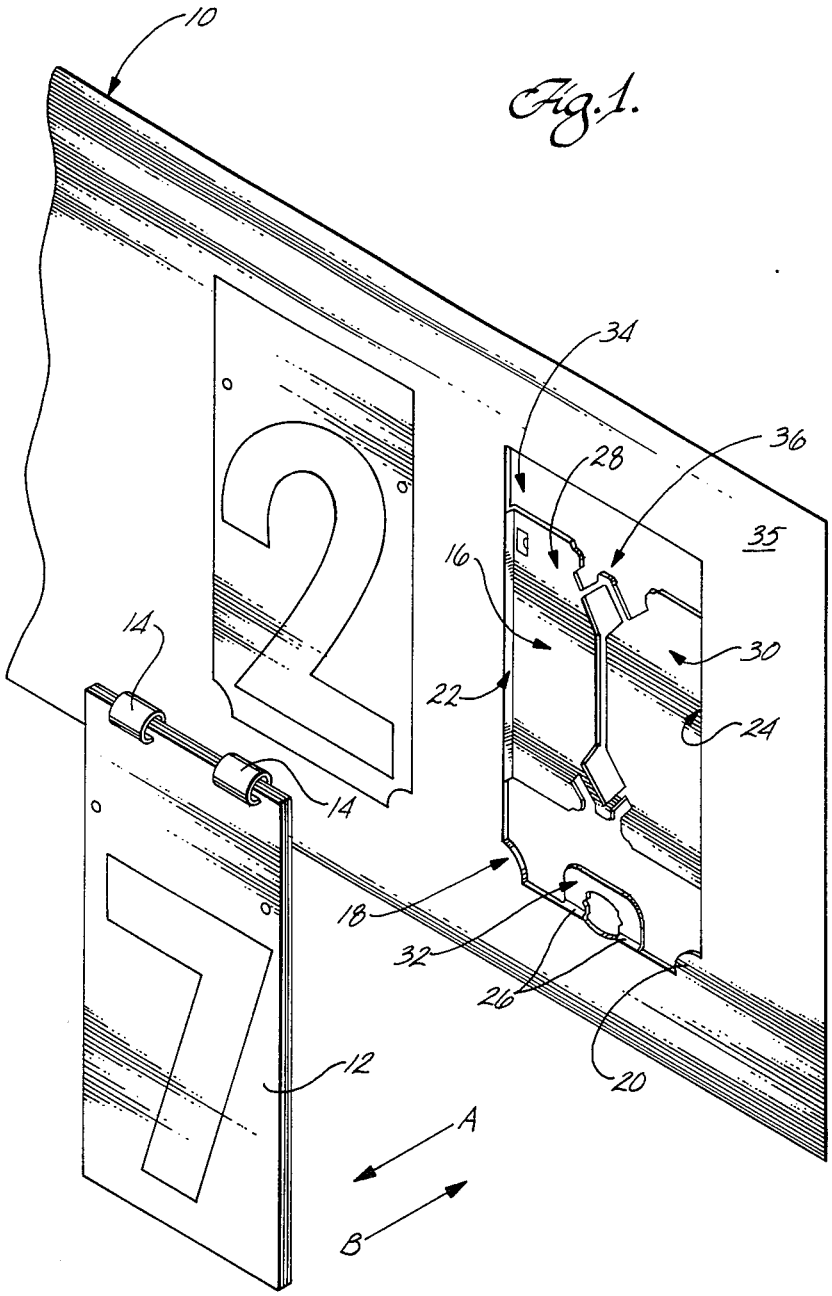
FIG. 1 is a perspective view of a front of a sign panel according to the present invention.

Refer now to FIG. 1 which discloses a preferred embodiment of the present invention. FIG. 1 discloses a sign holder 10 for a packet 12 of planar character-bearing members. The character-bearing members are each rectangular cards or the like made of metal or plastic which bear characters such as numerals or letters for display purposes. The top edges of the cards are connected together and pivoted about a pair of spaced apart ring-shaped clips 14.

The sign holder 10 is formed from deformable material such as a substantially planar sheet of aluminum or steel. All of the material is initially in the plane of the front planar portion 35 of sign holder 10.

The sheet portion has, formed therefrom, one or more pockets such as pocket 16 for receipt of a separate packet 12. The pocket has front retaining walls or tabs 18 and 20 which are in the plane of the sheet portion 35 and are formed from the sheet portion so as to prevent the packet 12 from moving out of the pocket in the direction A indicated in FIG. 1. The pocket 16 also includes, pressed from the sheet portion in a rearwardly direction B, and away from the direction A, walls of the pocket which retain the packet from moving rearwardly in direction B as well as in a transverse direction. Included are first and second opposed and spaced-apart side walls 22 and 24 (side wall 24 being hidden in FIG. 1 due to the perspective view) located at the left and right sides of the pocket, respectively, in FIG. 1. Also included is a third side wall 26 which is located in the lower side of the pocket intermediate the first and second side walls 22 and 24. The side walls 22, 24 and 26 retain the packet 12 in directions which are transverse to the front direction A and the reverse direction B.

Also included are first, second and third backing walls 28, 30 and 32 which are connected, respectively, to the first, second and third side walls 22, 24 and 26. The backing walls 28, 30 and 32 inhibit movement of the packet in the rearward direction B. To be explained in more detail, the side walls 22, 24 and 26 as well as the backing walls 28, 30 and 32 are all pressed in the direction B and hence away from the plane of the planar sheet.

Also included is at least one gap, generally depicted at 34, into which the backing walls 28, 30 and 32 project and which separates the backing walls 28, 30 and 32 from each other around three sides and from backing wall 32. Also included are bridges 36 across the at least one gap 34. The bridges 36 extend between the edges of the backing walls 28 and 30, and provide rigidity to the backing walls 28 and 30.

To be explained in more detail, prior to the step of pressing, all of the sign holder material lies in a single plane the same as the planar material 35 which surrounds the final pocket.

Figure 3:
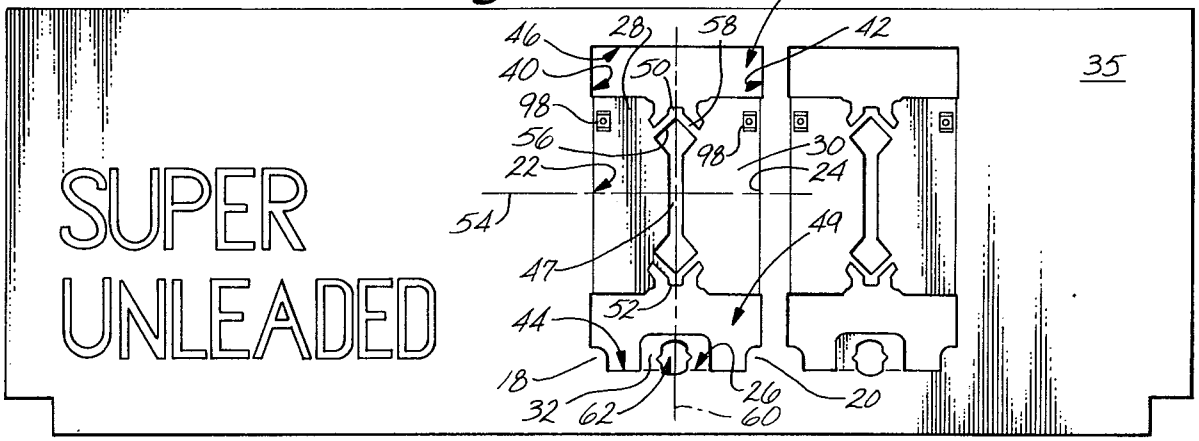
FIG. 3 is a front elevation view of the sign panel in a final formed condition.
Figure 4:
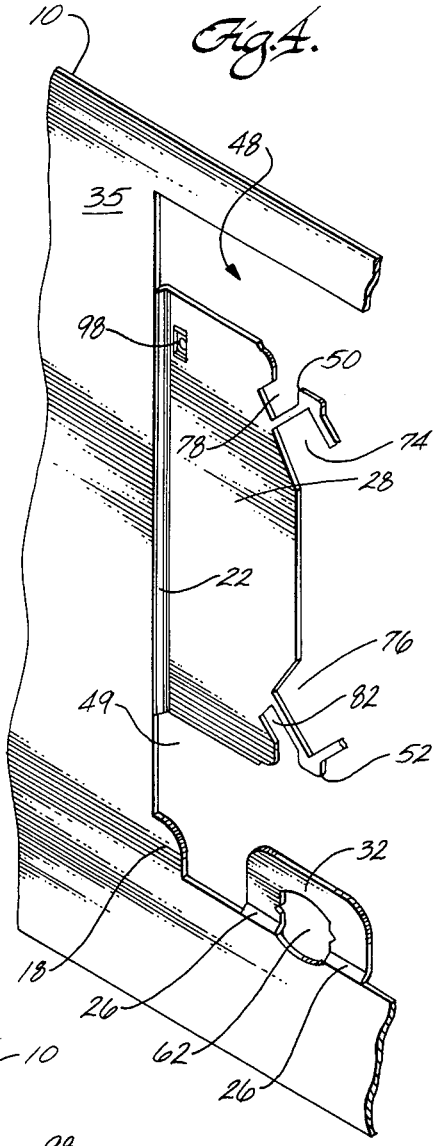
FIG. 4 is an enlarged perspective view of a cutaway portion of the sign panel of the present invention in final form.

Consider now the sign holder in more detail, with reference to FIGS. 1, 3 and 4. The sheet portion as indicated above includes planar portion 35 which is substantially all in a first common plane. Preferably the backing walls 28, 30 and 32 all lie substantially in a common second plane which is parallel with and is displaced rearwardly from the portion 35.

Preferably the pocket is rectangular, as seen from the front, with first lateral side 40, second lateral side 42, third lower side 44 and a fourth upper side 46 (see FIG. 3). The side 46 is adjacent the portion 35, which is in the front plane of the sheet portion. The side 44 is spaced from the side 46 and is located adjacent the backing wall 32. The at least one gap 34 is preferably composed of gaps 47, 48 and 49. Gap 48 is preferably generally rectangular-shaped and is located in the material adjacent to and above the backing walls 28 and 30 and between the sides 40 and 42. Gap 49 is preferably generally rectangular-shaped and is located on the lower side of backing walls 28 and 30. Gap 47 preferably extends substantially from gap 48 to gap 49. The gap 48 allows the packet to be inserted so that the packet may be extended up along the rear side (as seen in FIG. 3) of the portion 35 surrounding the pocket which is adjacent to side 46.

The tabs 18 and 20 are located, respectively, at the intersection of the sides 40 and 44 and the intersection of the sides 42 and 44 and extend into gap 49.

Consider now in more detail the bridges. The two bridges indicated at 50 and 52 are essentially identical with one being a mirror image of the other on opposite sides of center line 54. Both bridges extend across gap 47. Considering in more detail bridge 50, the bridge includes a plurality of interconnected bridge members 56 and 58 that extend between the edges of the backing walls 28 and 30. The interconnected bridge members 56 and 58 are connected so that they extend away from each other at an acute angle as seen in FIG. 3.

Preferably the bridge members 56 and 58 are connected together in an inverted V shape as seen in FIG. 3. Each bridge member has one end connected to an end of the other and a second end extending from and connected to the edge of a different one of the backing walls 28 and 30. Preferably the bridge members 56 and 58 are each elongated with substantially smaller diagonal cross-section dimensions than its length.

The bridge 52 is essentially identical to bridge 50 except that its V shape is inverted with the vortex pointing downward in the opposite direction from the vortex of bridge 50.

The bridges 50 and 52 are symmetrical about a center line 60 which is at right angles to center line 54. Similarly the backing wall 28 and the backing wall 30 are virtually identical in shape and are symmetrical about the center line 60 and one is a mirror image of the other.

An opening 62 is formed in the material adjacent the side 44 into which a finger may be extended for removal of the packet from the pocket. Preferably the opening 62 extends down in one direction from side 44 into the portion 35 surrounding the pocket and extends in the other direction from the side 44 through both the side wall 26 and the backing wall 32.

Figure 2:
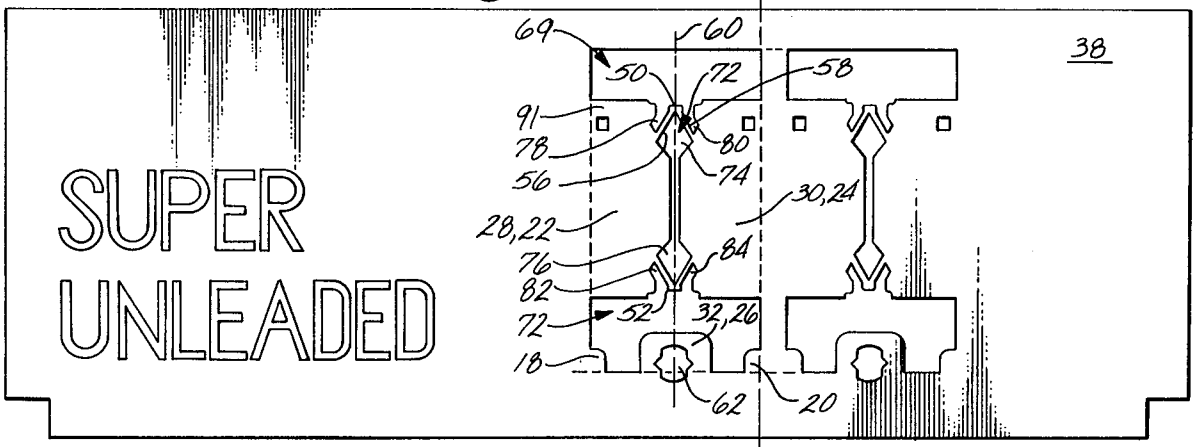
FIG. 2 is a front elevation view of the sign panel in a planar and pre-formed condition.

With the construction of the sign holder in mind, consider the process for making the sign holder with reference to FIGS. 2 and 3. Initially a planar sheet portion 38 of material is selected similar to that depicted in FIG. 2 but without the cutouts. Next, gaps are formed in the material. The gaps may be formed in a number of different ways known in the art, such as by punching or cutting. A generally rectangular-shaped gap 69 and, spaced therefrom along center line 60, a generally rectangular-shaped gap 70 are formed in the planar material 38. The gaps 34 and 70 are above and below on the opposite sides of the material for backing walls 28 and 30 and side walls 22 and 24. While forming gap 70, generally rectangular-shaped tabs 18 and 20 and a rectangular projection for backing wall 32 and side wall 26 are left in the planar material and extend from the planar material 38 into gap 70.

The step of forming also forms an elongated gap 72 extending along center line 60 substantially from the gap 69 to the gap 70. As will be seen, the step of forming gaps 69, 70 and 72 leaves the bridges 50 and 52 within the gap 72.

After the gaps, or openings, are formed in the sheet portion 38, the backing walls 28, 30 and 32, as well as the side walls 22, 24 and 26, are forced out of the plane of the sheet portion 38 rearwardly into the plane of the drawing of FIG. 2 so that the side walls 22, 24 and 26 are formed as depicted in FIGS. 1, 3 and 4 (only partially seen in FIG. 4), and the backing walls 28, 30 and 32 are in a plane parallel to the sheet portion 35, all as described with reference to FIG. 1.

To be explained in more detail, the bridges 50 and 52 have weakened portions. The step of forcing causes the backing walls to further separate to accommodate the additional material used in forming side walls 22 and 24. The weakened portions of the bridges allow deformation of the bridges at the weakened portions and thereby allow further separation between adjacent edges of the backing walls 28 and 30. However, the connection is maintained by the bridges between the two backing walls 28 and 30 so as to retain rigidity between the opposed sides of the backing walls 28 and 30.

The step of leaving a bridge and forming a weakened portion in the bridge includes the step of removing material from the sheet to form a bridge having a plurality of bridge members, i.e., 56 and 58, with connections between the bridge members and between the backing walls and the bridge members, and forming a weakened portion at at least one of the interconnections. To this end, diamond-shaped gaps or cutouts 74 and 76 are formed in the material between the legs of the V-shaped bridges 50 and 52, respectively. In addition, elongated gaps or slots 78 and 80, extending at an acute angle to each other, are formed on the opposite sides of the legs of the bridge 50 from slot 74. Also elongated slots 82 and 84, extending at an acute angle to each other, are formed on the opposite sides of the legs of the bridge 52 from gap 76. The slots 78 and 80 in conjunction with the diamond-shaped gap 74, and similarly, slots 82 and 84 in conjunction with gap 76, weaken the junctions between bridge members and the junctions between the bridge members and the backing walls, allowing the deformation to take place at the junctions.

Figure 6:
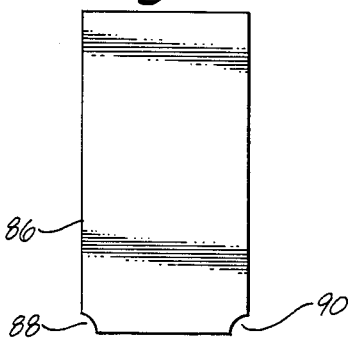
FIG. 6 is a plan view of a press or die block for use in practicing the method according to the present invention.
Figure 7:
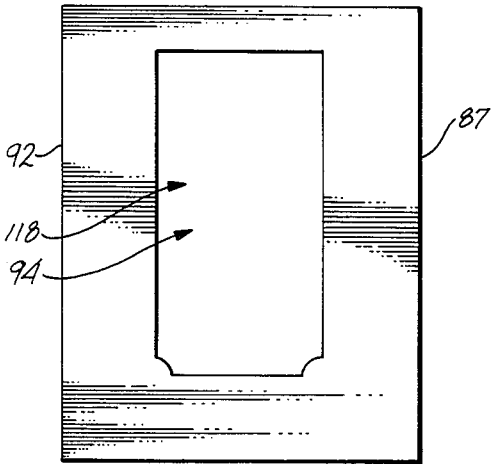
FIG. 7 is a backing member or die block for use with the die block of FIG. 6 in practicing the method according to the present invention.

The step of forcing the backing walls and side walls rearward may be performed in a number of different ways. For example, a pair of die blocks, such as depicted in FIGS. 6 and 7, may be employed. FIG. 6 depicts a die block 86 which is generally rectangular shaped, fitting within the rectangular area formed by pocket sides 40, 42, 44 and 46. The die block includes corner recesses 88 and 90 which contour around and do not press the tabs 18 and 20.

The die block 87 depicted in FIG. 7 is in the form of a plate having a recess 92 whose perimeter is slightly larger than and is of the same shape as the outer perimeter of die block 86. During the step of forcing, the die block 86 is placed on the upper side of the sheet portion depicted in FIG. 2 and the die block 92 is positioned on the back side with the die block 86 in register with the recess 92. The die block 86 and the die block 92 are positioned within the rectangular outline formed by sides 40, 42, 44 and 46. Then the two die blocks are pressed together to press the backing walls and the side walls rearward. Alternately, the forcing step may be performed by rolling.

Figure 5:
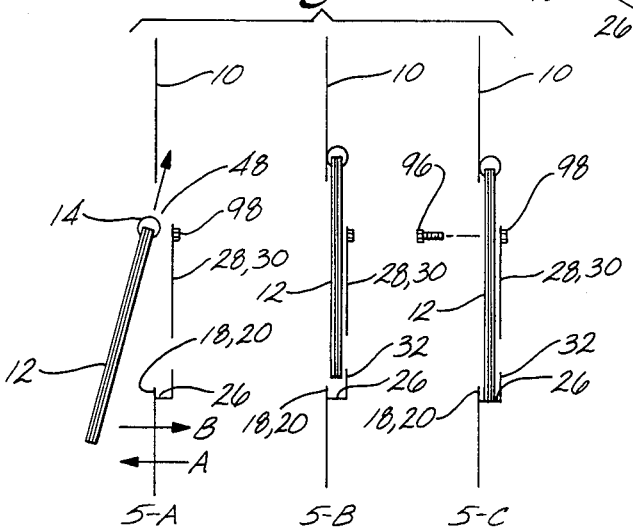
FIG. 5, composed of FIGS. 5A, 5B and 5C, is a cross-sectional and schematic side elevation view of a sign panel with a number pack showing various steps in the process of insertion of the number pack.
Figure 8:
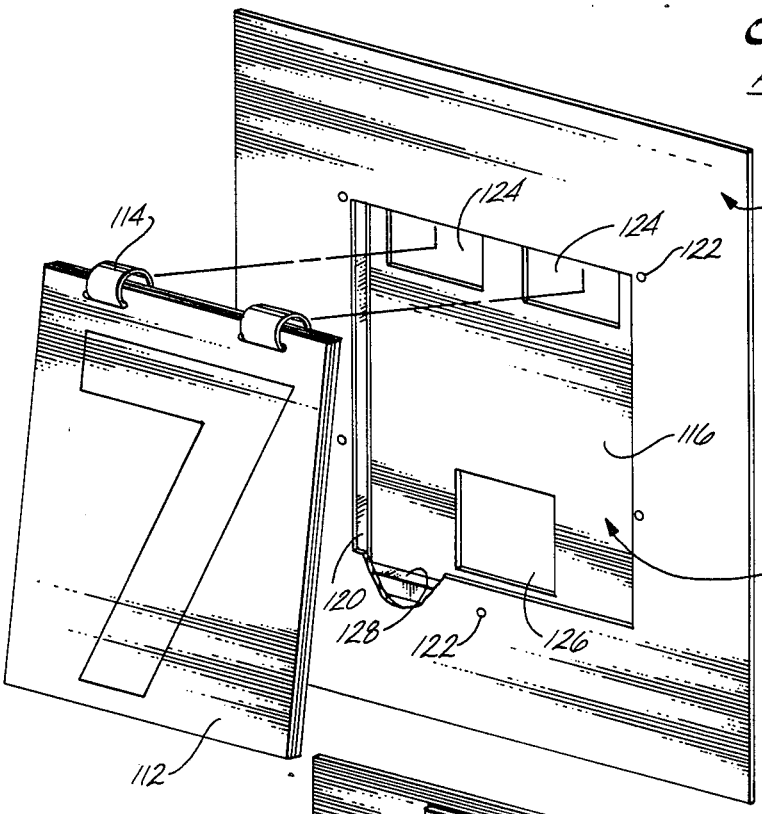
Fig. 8. PRIOR ART
FIG. 8 is a perspective view of a front of a prior art sign holder.
Figure 9:
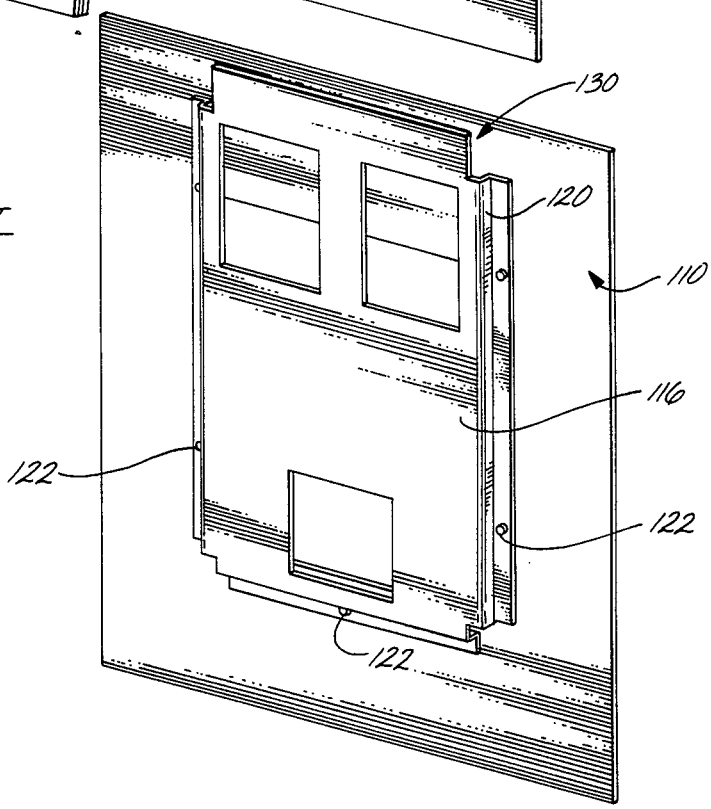
Fig. 9. PRIOR ART
FIG. 9 is a perspective view of a back of the prior art sign holder.

In use, the packet 12 may be inserted into the sign holder in the three steps depicted in FIGS. 5A, 5B and 5C (forming FIG. 5). Specifically, the packet 12 is inserted into gap 34 while holding the packet at an angle to the planar portion 35 of the sign holder. The upper end of the packet including the clip 14 easily passes into and through the gap 48 and behind the front portion of the sheet portion. The lower end of the packet is then pushed into the pocket until it is parallel with the backing walls 28 and 30 and then the packet is dropped down behind the tabs 18 and 20, in front of the backing wall 32 until it rests on side wall 26. Subsequently, if desired, a screw 96 may be passed through a hole in the packet 12 and threaded into a cage nut 98 which is mounted in a hole formed in one of the backing walls to retain the packet in the pocket.

It should be noted that the above embodiment is a preferred configuration but others are foreseeable. The described embodiment of the invention is only considered to be preferred and illustrative of the inventive concepts; the scope of the invention is not to be restricted to such embodiment.

What is claimed is:

1. A sign holder for a packet of planar members bearing characters for display comprising:

deformable material having a sheet portion comprising a pocket for receipt of the packet, the pocket comprising a front retaining wall formed from the sheet portion to prevent the packet from moving out of the pocket in a front direction, the pocket further comprising, pressed from the sheet portion in a direction away from the front direction, first and second opposed and spaced apart side walls, a third side wall located in the pocket intermediate the first and second side walls, the first, second and third side walls retaining the packet in directions transverse to the front direction, first, second and third backing walls, connected respectively to the first, second and third side walls, the first, second and third backing walls inhibiting movement of the packet in a direction opposite to the front direction, the pressed sheet of material comprising at least one gap for substantially separating the first, second and third backing walls from each other, and at least one bridge in the at least one gap extending between and providing rigidity to the first and second backing walls.

2. A sign holder according to claim 1 wherein the sheet portion comprises a portion substantially in a first plane and wherein the first, second and third backing walls are substantially in a second plane.

3. A sign holder according to claim 1 wherein the pocket comprises first, second, third and fourth sides, the fourth side being located adjacent material of the sheet portion and the third side being spaced from the fourth side and being located adjacent the third backing wall, the third and fourth sides being located intermediate the first and second side walls, the holder comprising a further gap in the material adjacent the first and second backing walls and between the first and second sides into which the packet may be inserted for extension along the material adjacent to the fourth side.

4. A sign holder according to claim 3 wherein the pocket is substantially rectangular in shape defined by the first, second, third and fourth sides, and wherein the first and second sides extend, respectively, along the first and second side walls, and wherein the third side extends along the third side wall.

5. A sign holder according to claim 4 wherein the front wall comprises at least one extension of the material into the rectangular-shaped pocket.

6. A sign holder according to claim 4 wherein the front wall comprises at least two extensions, one approximately at the intersection of the first and third sides and the other at the intersection of the second and third sides.

7. A sign holder according to claim 1 wherein the bridge comprises a plurality of interconnected bridge members, extending between the first and second backing walls, adjacent bridge members extending at an acute angle away from each other.

8. A sign holder according to claim 7 wherein the bridge members are connected together in a V shape, each bridge member having a first end connected to the first end of the other and a second end connected to a different one of the first and second backing walls.

9. A sign holder according to claim 1 wherein the bridge comprises an elongated portion extending from the first backing wall to the second backing wall, having a substantially smaller cross-section than the length of the elongation thereof.

10. A sign holder according to claim 1 wherein the bridge is V-shaped.

11. A sign holder according to claim 10 comprising a second bridge substantially the same in shape and construction as the first named bridge connected between the first backing wall and the second backing wall.

12. A sign holder according to claim 11 wherein the junction of the legs of each V-shaped bridge is on a line intermediate the first and second backing wall portions.

13. A sign holder according to claim 3 comprising an opening in the sheet portion adjacent the third side into which a finger may be extended for removal of the packet from the pocket.

14. A sign holder according to claim 13 wherein the opening extends in one direction from the third side into the sheet portion outside of the pocket and extends in another direction from the third side into the third backing wall.

* * * * *